US009105414B2

(12) United States Patent
Flegel

(10) Patent No.: US 9,105,414 B2
(45) Date of Patent: Aug. 11, 2015

(54) PLUG-TYPE POWER SUPPLY CONNECTOR FOR A POWER INPUT SELECTOR SWITCH

(71) Applicant: Reliance Controls Corporation, Racine, WI (US)

(72) Inventor: Michael O. Flegel, Racine, WI (US)

(73) Assignee: Reliance Controls Corporation, Racine, WA (US)

( * ) Notice: Subject to any disclaimer, the term of this patent is extended or adjusted under 35 U.S.C. 154(b) by 0 days.

(21) Appl. No.: 14/298,129

(22) Filed: Jun. 6, 2014

(65) Prior Publication Data

US 2014/0284186 A1 Sep. 25, 2014

Related U.S. Application Data

(62) Division of application No. 13/337,820, filed on Dec. 27, 2011, now Pat. No. 8,779,309.

(60) Provisional application No. 61/427,650, filed on Dec. 28, 2010.

(51) Int. Cl.

| | |
|---|---|
| ***H01H 9/20*** | (2006.01) |
| ***H01H 3/16*** | (2006.01) |
| ***H01H 9/08*** | (2006.01) |
| ***H01H 9/24*** | (2006.01) |
| *H01H 9/16* | (2006.01) |

(52) U.S. Cl.

CPC ..... *H01H 9/20* (2013.01); *H01H 9/085* (2013.01); *H01H 9/24* (2013.01); *H01H 9/161* (2013.01); *H01H 2300/018* (2013.01)

(58) Field of Classification Search

CPC ... H01H 2223/04; H01H 3/0206; H01H 3/42; H01H 47/02; H01H 50/18; H01H 53/14; H01H 9/0027; H01H 9/0038; H01H 9/20; H01H 9/36; H01H 9/54

USPC ..... 200/50.1, 50.3, 50.31, 51.03, 51.08, 200/51.1

See application file for complete search history.

(56) References Cited

U.S. PATENT DOCUMENTS

| | | | |
|---|---|---|---|
| 2,967,917 | A | 1/1961 | Cole |
| 4,112,270 | A | 9/1978 | Rys |
| 5,623,135 | A | 4/1997 | Hashimoto et al. |
| 6,570,269 | B2 | 5/2003 | McMillan et al. |
| 6,791,211 | B1 | 9/2004 | Flegel |
| 6,919,518 | B2 | 7/2005 | Rademacher et al. |
| 7,009,128 | B1 | 3/2006 | Czarnecki et al. |
| 7,286,340 | B2 | 10/2007 | Karim et al. |
| 7,435,920 | B1 | 10/2008 | Yoo |
| 7,557,683 | B1 | 7/2009 | Wang |
| 7,834,282 | B2 | 11/2010 | Flegel |
| 8,030,799 | B1 | 10/2011 | Flegel |
| 8,098,465 | B1 | 1/2012 | Flegel |

*Primary Examiner* — Kyung Lee

(74) *Attorney, Agent, or Firm* — Boyle Fredrickson, S.C.

(57) ABSTRACT

A transfer switch mountable in a standard electrical panel connects either a utility supply or an auxiliary supply to an electrical system. An internal mechanical interlock prevents both the utility supply and the auxiliary supply from simultaneously being connected to the system. The transfer switch may utilize either a rocker-style or a blade style switch. A light-emitting diode provides an indication of whether the utility supply is connected to and a voltage is present at the utility supply terminal. A power meter provides an indication of the magnitude of power drawn from the auxiliary supply when the auxiliary supply is connected to the load.

8 Claims, 11 Drawing Sheets

PLUG-TYPE POWER SUPPLY CONNECTOR FOR A POWER INPUT SELECTOR SWITCH

CROSS-REFERENCE TO RELATED APPLICATIONS

This application is a divisional of application Ser. No. 13/337,820, filed Dec. 27, 2011, which claims the benefit of U.S. Ser. No. 61/427,650 , filed Dec. 28, 2010, the entire contents of which is incorporated herein by reference.

BACKGROUND OF THE INVENTION

This application is directed to an electrical transfer switch and, more particularly, to an electrical transfer switch mountable in a standard electrical panel and having an internal interlock.

Typically, a transfer switch assembly is used to connect an auxiliary power supply with certain electrical circuits in a building. The transfer switch assembly includes a first input switch engaged with electrical conductors connected to the utility supply and a second input switch engaged with electrical conductors connected to the auxiliary power supply. In order to prevent both input switches from being ON simultaneously, either the housing of the transfer switch assembly or an external interlock device is typically configured to provide a mechanical interference between the two input switches. The mechanical interference may be, for example, a rigid device directly coupled between the switch arms of the switches or a plate slidably mounted to the housing such that only one of the input switches at a time may be in the ON position to connect an electrical power supply to the electrical system.

A transfer switch assembly typically includes a separate sub-panel, requiring additional installation cost and space. Optionally, an input switch for the auxiliary power supply may be added to a standard electrical panel; however, due to the many sizes and arrangements of electrical panels, a mechanical interlock must then be specially configured between the utility input switch and the auxiliary input switch. Thus, it would be desirable to provide a single input switch mountable in a standard electrical panel which selectively connects either the utility supply or the auxiliary supply to a building's electrical load. Further, if use of a sub-panel is advantageous due to the application requirements, the input switch is similarly mountable in any standard electrical panel configured to fit within the sub-panel.

SUMMARY OF THE INVENTION

The present invention provides a transfer switch mountable in a standard electrical panel. The transfer switch connects either the utility supply or an auxiliary supply to an electrical system. An internal mechanical interlock prevents both the utility supply and the auxiliary supply from simultaneously being connected to the system. A light-emitting diode (LED) provides an indication of whether the utility supply is connected to, and a voltage is present at, the utility supply terminal. A power meter provides an indication of the magnitude of power drawn from the auxiliary supply when the auxiliary supply is connected to the load.

According to one embodiment of the invention, the input switch selectively connects either a first power supply or a second power supply to an electrical load via a bus in an electrical panel. The input switch includes a housing, a first connector configured to receive power from the first power supply, and a first contact contained within the housing and electrically connected to the first connector. The input switch further includes a second connector configured to receive power from the second power supply, a second contact contained within the housing and electrically connected to the second connector, and a load contact configured to engage the bus in the electrical panel. A switch arm is operatively mounted to the housing for movement between a first position and a second position and connects the first contact with the load contact in the first position and the second contact with the load contact in the second position. A mechanical interlock within the housing is operatively connected to the first and second contacts to disconnect one of the first or the second contacts from the load contact prior to connecting the other of the first or the second contacts to the load contact when the switch is moved between the first and the second positions.

Thus, it is a feature of the present invention to provide a single input switch mountable in the standard electrical panel which selectively connects either the utility supply or the auxiliary supply to an electrical load.

According to another aspect of the invention, the switch arm may include a first end extending outside the housing, a second end extending inside the housing, and a pivotal connection proximate to an upper wall of the housing, wherein the second end engages the mechanical interlock. Optionally, the housing may have an upper wall with a first opening and a second opening, and the switch arm may include a handle extending outside the housing, a plate configured to cover both the first opening and the second opening, and at least one plug extending into the housing. The first position is then defined by the plug inserted into the first opening and the second position is defined by the plug inserted into the second opening.

According to still another aspect of the invention, a retaining assembly positively connects the input switch to the bus. The retaining assembly may include a threaded member rotatably engaged with the housing; a locking member slidably engaged with the housing; and a lever engaged at a first end by the threaded member, engaged at a second end by the locking member, and pivotally engaged with the housing at a point along the lever between the first and second ends. A power meter may be operably connected between the second terminal and the second contact to indicate the amount of power drawn from the second power supply. A visual indicator may be activated when the first power supply is connected to the first connector and has power available to be supplied to the load.

According to yet another aspect of the invention, the input switch may further include a third connector configured to be connected to the first power supply and a third contact contained within the housing and electrically connected to the first connector. A fourth connector is configured to be connected to the second power supply, and a fourth contact is contained within the housing and electrically connected to the second connector. A second load contact is removably engageable with a second bus in the electrical panel. The switch arm connects the third contact with the second load contact in the first position and the fourth contact with the second load contact in the second position. The mechanical interlock disconnects one of the third or the fourth contacts from the second load contact prior to connecting the other of the third or the fourth contacts when the switch arm is moved between the first and the second positions. Optionally, a first neutral connector is interconnected with the first power supply and a second neutral connector is interconnected with the second power supply. The switch arm selectively engages either the first neutral connector or the second neutral connector.

According to another embodiment of the invention, an input switch selectively connects either a first power supply or a second power supply to an electrical load via a bus in an electrical panel. The input switch includes a housing having a first end, a second end, a first side, a second side, a lower wall, and an upper wall. A first connector extends through either the first end or the second end and is configured to receive power from the first power supply. A second connector extends through either the first end or the second end and is configured to receive power from the second power supply. A load contact extends through the lower wall and is configured to engage the bus proximate to the lower wall. A switch arm extends through the upper wall and is configured to selectively connect the first connector with the load contact in a first position and the second connector with the load contact in a second position. A retaining assembly has a drive portion and a driven portion, wherein the driven portion is selectively moved between a first position and a second position by the drive portion. The driven portion positively retains the housing to the electrical panel in one of the first position and the second position.

According to another aspect of the invention, the driven portion is configured to be rotatable with a separate tool between the first position and the second position. The electrical panel includes a first rib configured to extend generally perpendicular to the first end of the housing, and the driven portion engages the first rib to positively retain the housing to the electrical panel.

According to yet another aspect of the invention, a mechanical interlock within the housing is operatively connected between the first connector and the second connector. The mechanical interlock disconnects one of the first or the second connectors from the load contact prior to connecting the other of the first or the second connectors when the switch arm is moved between the first and the second positions. The switch arm may include a first end extending through the upper wall, a second end extending inside the housing, and a pivotal connection proximate to the upper wall of the housing, wherein the second end engages the mechanical interlock.

According to another embodiment of the invention, an input switch selectively connects either a first power supply or a second power supply to an electrical load via a bus in an electrical panel. The input switch includes a housing having a first and a second opening extending therethrough, a load contact configured to engage the bus in the electrical panel, a first connector configured to receive power from the first power supply, and a first receptacle aligned with the first opening in the housing. The first receptacle has a first surface and a second surface electrically isolated from each other. The first surface is electrically connected to the first connector and the second surface is electrically connected to the load contact. A second connector is configured to receive power from the second power supply. A second receptacle is aligned with the second opening in the housing and has a first surface and a second surface electrically isolated from each other. The first surface is electrically connected to the second connector and the second surface is electrically connected to the load contact. A movable selection device has a plug portion configured to selectively establish an electrical connection between the first and the second surfaces of either the first or the second receptacles.

According to another aspect of the invention, a first spring-biased contact may have a first plunger slidably engaging a second end of the first receptacle. A first spring biases the first spring-biased contact in a normally open position and the movable selection device engages the first plunger to compress the first spring, closing the first spring-biased contact. A second spring-biased contact may have a second plunger slidably engaging a second end of the second receptacle. A second spring biases the second spring-biased contact in a normally open position and the movable selection device engages the second plunger to compress the second spring, closing the second spring-biased contact.

According to yet another aspect of the invention, the housing may have a third and a fourth opening extending therethrough. The input switch further includes a second load contact configured to engage a second bus in the electrical panel, a third connector configured to connect to the first power supply, and a third receptacle aligned with the third opening in the housing. The third opening has a first surface and a second surface electrically isolated from each other. The first surface is electrically connected to the third connector and the second surface is electrically connected to the second load contact. A fourth connector is configured to connect to the second power supply, and a fourth receptacle is aligned with the fourth opening in the housing. A first surface and a second surface of the fourth receptacle are electrically isolated from each other. The first surface is electrically connected to the fourth connector and the second surface is electrically connected to the second load contact. The plug portion of the movable selection device is configured to selectively establish an electrical connection between the first and the second surfaces of either the first and the third receptacles or the second and the fourth receptacles.

According to still another aspect of the invention, the housing may have a third and a fourth opening extending therethrough. The input switch further includes a neutral conductor extending through the housing configured to be connected to a neutral connection within the electrical panel. A third connector is configured to receive a neutral connection from the first power supply, and a third receptacle is aligned with the third opening in the housing. The third receptacle has a first surface and a second surface electrically isolated from each other. The first surface is electrically connected to the third connector and the second surface is electrically connected to the neutral conductor. A fourth connector is configured to receive a neutral connection from the second power supply, and a fourth receptacle is aligned with the fourth opening in the housing. The fourth receptacle has a first surface and a second surface electrically isolated from each other. The first surface is electrically connected to the fourth connector and the second surface is electrically connected to the neutral conductor. The plug portion of the movable selection device may be configured to selectively establish an electrical connection between the first and the second surfaces of the first and the third receptacles in a first position and between the first and the second surfaces of the second and the fourth receptacles in a second position. When the input switch is in the first position, the movable selection device establishes the electrical connection between the first and the second surface of the third receptacle prior to establishing the electrical connection between the first and the second surface of the first receptacle and breaks the electrical connection between the first and the second surface of the first receptacle prior to breaking the electrical connection between the first and the second surface of the third receptacle. When the input switch is in the second position, the movable selection device establishes the electrical connection between the first and the second surface of the fourth receptacle prior to establishing the electrical connection between the first and the second surface of the second receptacle, and breaks the electrical connection between the first and the second surface of the second receptacle prior to breaking the electrical connection between the first and the second surface of the fourth receptacle.

BRIEF DESCRIPTION OF THE DRAWINGS

The drawings illustrate the best mode presently contemplated of carrying out the invention.

In the drawings.

Figure 1:
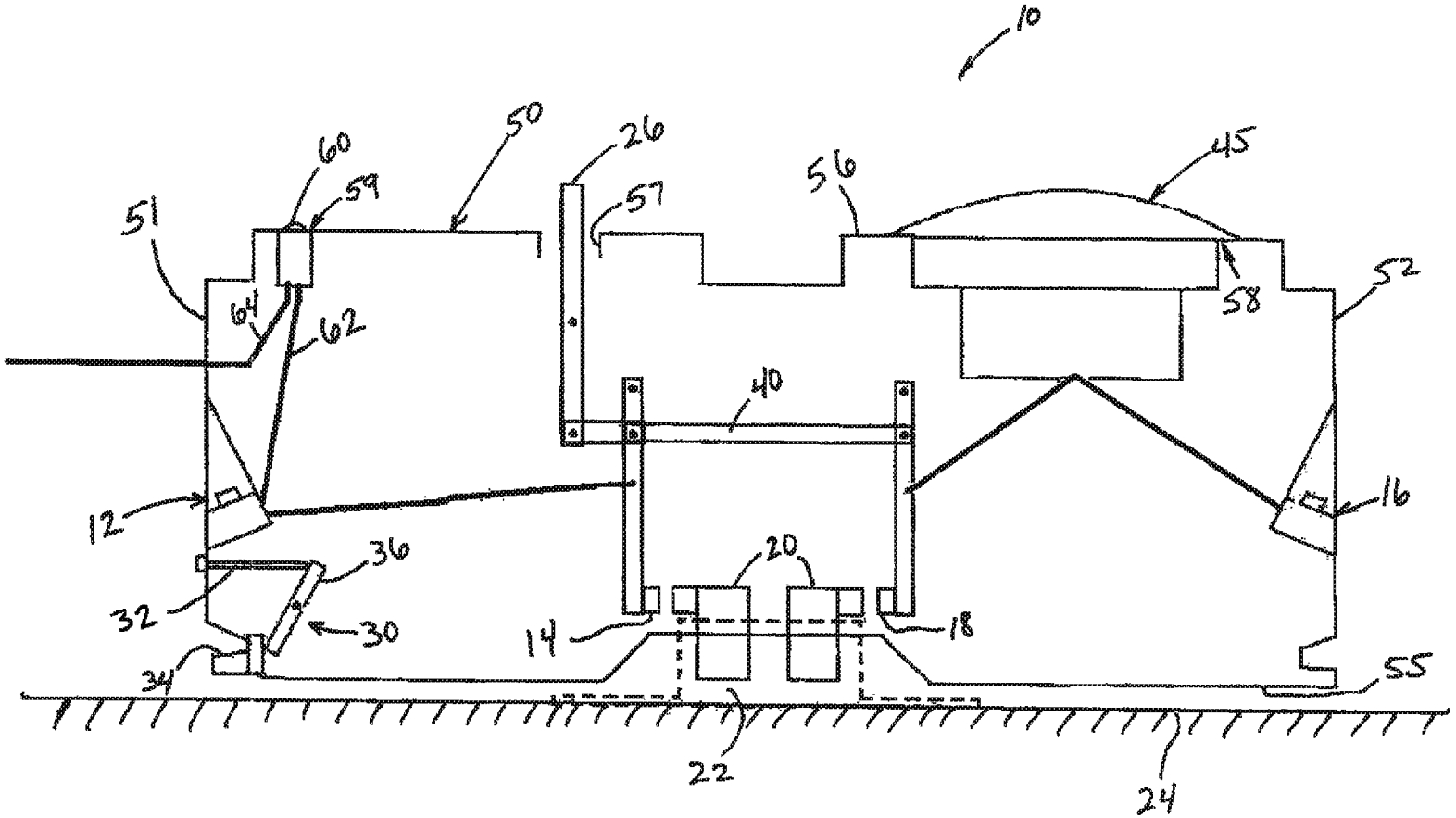
FIG. 1 is a schematic representation of a transfer switch including an internal connection between a terminal and a bus according to one embodiment of the present invention.

In describing the representative embodiments of the invention which are illustrated in the drawings, specific terminology will be resorted to for the sake of clarity. However, it is not intended that the invention be limited to the specific terms so selected and it is understood that each specific term includes all technical equivalents which operate in a similar manner to accomplish a similar purpose. For example, the word "connected," "attached," or terms similar thereto are often used. They are not limited to direct connection but include connection through other elements where such connection is recognized as being equivalent by those skilled in the art.

DETAILED DESCRIPTION

Specific embodiments of the present invention will now be further described by the following, non-limiting examples which will serve to illustrate various features of the invention. With reference to the drawing figures, like reference numerals designate like parts throughout the disclosure.

Referring to FIG. 1, an input switch 10 for mounting in an electrical panel 24 is disclosed. The input switch 10 includes a housing 50 which may be configured to mount in a standard electrical panel 24. The input switch 10 includes a first terminal 12 on a first end 51 of the housing 50 and a second terminal 16 on a second end 52 of the housing 50. Optionally, the first and second terminals, 12 and 16 respectively, may be located in any suitable position on the housing 50 for connecting an electrical conductor, such as a wire. Each terminal, 12 or 16, may be any suitable connector which positively retains an electrical conductor, for example, with a screw-type or a spring-loaded clamping member. A conductor from a first power supply, such as a utility grid, is connected to the first terminal 12, and a conductor from a second power supply, such as a backup generator, is connected to the second terminal 16.

The input switch 10 also includes a load contact 20 removably connected to a bus bar 22 in the electrical panel 24. The load contact 20 may be constructed of either a unitary conductive member or, optionally, be constructed of multiple conductive members or a combination of conductive and non-conductive members. The load contact 20 is configured to make a first electrical connection internal to the housing 50 and extends through the lower surface 55 of the housing 50 to slide, snap, hook, or otherwise connect to the bus 22, according to the configuration of the bus 22, to make a second electrical connection.

The first and second terminals, 12 and 16 respectively, are selectively connected to the load contact 20 within the housing 50. The first terminal 12 is electrically connected, for example by a wire, to a first contact 14, and the second terminal 16 is electrically connected, for example by a wire, to a second contact 18. The first and second contacts, 14 and 18 respectively, are coupled to a switch arm 26 by a mechanical interlock 40. The switch arm 26 extends through an opening 57 in the upper wall 56 of the housing 50. The switch arm 26 is selectively positioned between a first and a second position.

The input switch 10 may further include a retaining assembly 30 configured to positively retain the input switch 10 in engagement with the bus 22 in the electrical panel 24. The retaining assembly 30 may include a drive portion and a driven portion. The drive portion includes a protrusion or a recess complementary to a tool used to move the drive portion. The drive portion engages the driven portion, causing the driven portion to alternately engage or disengage the input switch 10 with the electrical panel 24. According to one embodiment, the retaining assembly 30 may include a threaded member 32, such as a screw, extending through the housing 50. The end or head of the threaded member 32 external to the housing 50 includes a recess configured to receive a tool, for example, a screwdriver, allen wrench, torx or box head driver, or any other suitable tool, for rotating the threaded member 32. Rotation of the threaded member 32 engages the wall of the housing 50 to drive the threaded member 32 further into or out of the housing 50. The end of the threaded member 32 internal to the housing 50 engages a first end of a pivotable lever 36. A second end of the lever 36 engages a locking member 34. The lever 36 is pivotally connected to the housing 50 at a point between the first and second ends. The locking member 34 slidably extends from and retracts toward the housing 50 to engage and disengage a hook, lip, rib, or other retaining member provided on the electrical panel 24. Although one embodiment of the retaining assembly 30 is described, it is contemplated that other suitable assemblies may similarly engage the electrical panel 24 to retain the input switch 10 in engagement with the bus 22.

The input switch 10 may also include a power meter 45 mounted on the housing 50. The power meter 45 may be mounted on the upper wall 56 of the housing for ease of viewing. The power meter 45 is connected between the second terminal 16 and the second contact 18. The power meter 45 is configured to read the magnitude of the voltage present at and/or the current flowing from the auxiliary power supply. The power being delivered from the auxiliary power supply may subsequently be determined and displayed on the power meter 45. Alternatively, the power meter 45 may measure current in the wire between second terminal 16 and second contact 18 (or in any other satisfactory conductor) using a current transformer in order to provide a power reading.

The input switch 10 may further include a visual indicator 60, such as an LED, mounted on the housing 50. A first terminal 62 of the visual indicator 60 is connected to the first terminal 12, and a second terminal 64 of the visual indicator 60 is connected to the neutral bus (not shown) in the electrical panel 24. When the primary supply is connected to and a voltage is present at the first terminal 12, the visual indicator 60 will be energized to indicate the presence of voltage at the first terminal 12.

Figure 2:
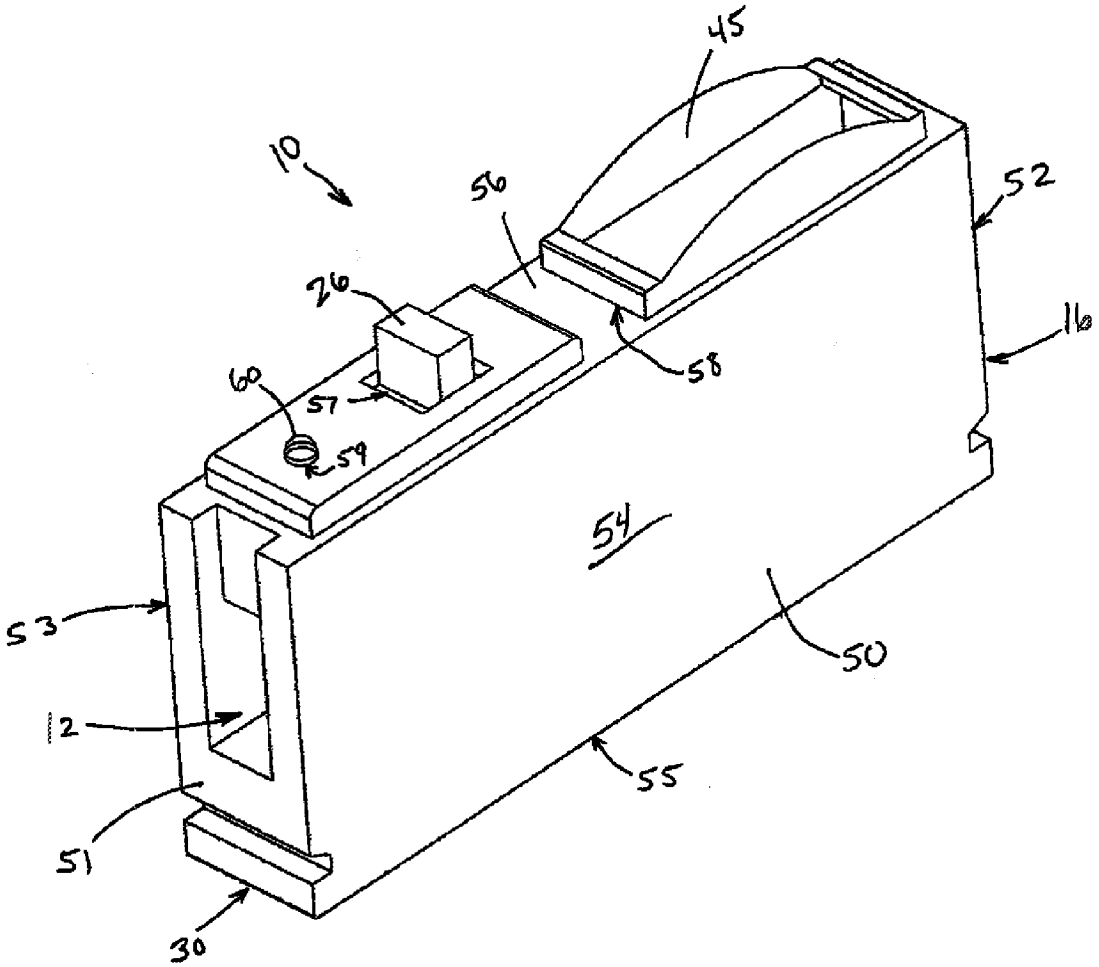
FIG. 2 is a perspective view of a single pole transfer switch as in FIG. 1, incorporating the internal interlock of the present invention.
Figure 3:
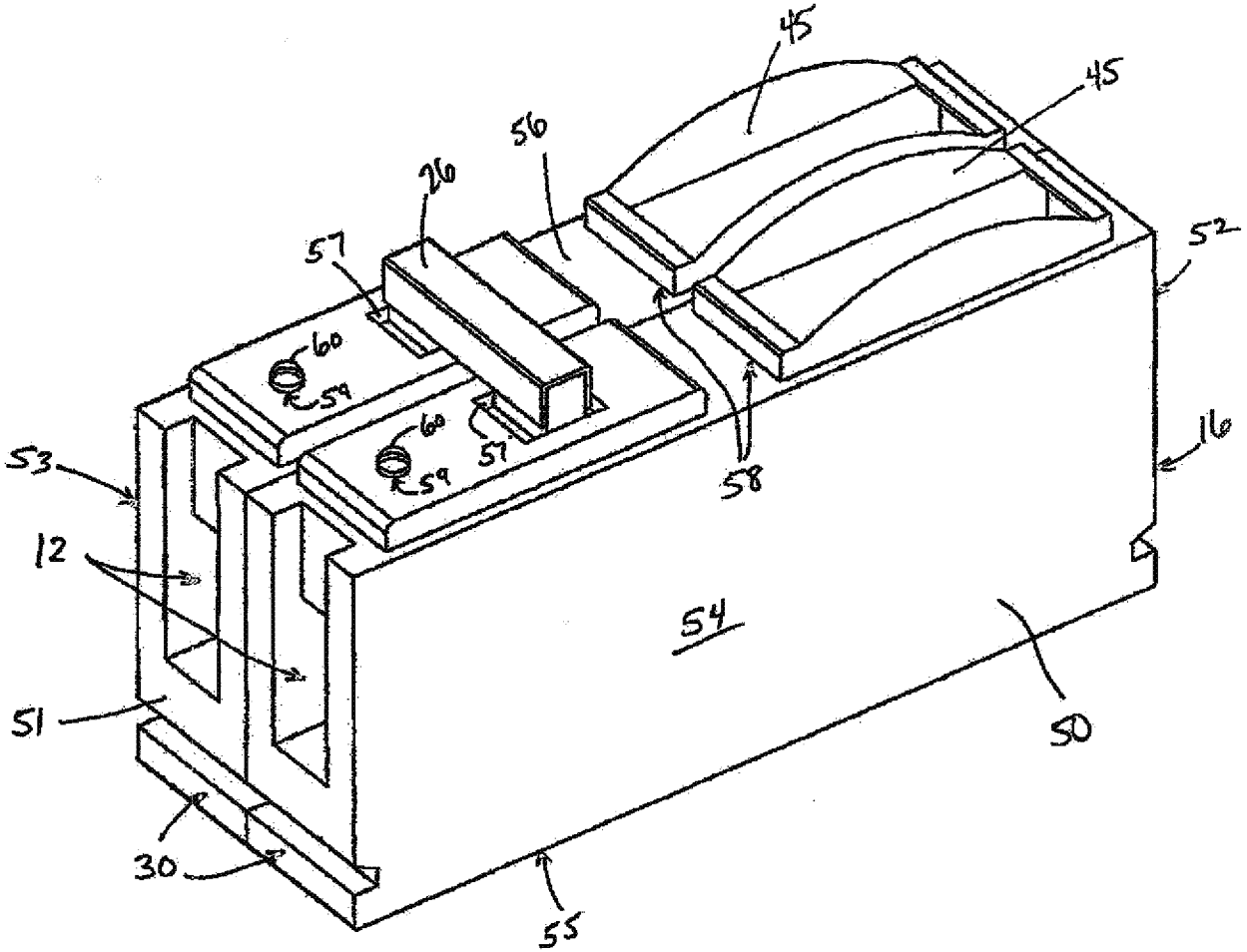
FIG. 3 is a perspective view of a double pole transfer switch in the form of two side-by-side transfer switches as in FIG. 1, which incorporate the internal interlock of the present invention.

Referring next to FIGS. 2 and 3, the input switch according to one embodiment of the present invention may be incorporated, for example, as a single pole or a double pole switch. According to one embodiment of the invention, additional poles are added by adding segments to the housing that reproduce the internal electrical connections and utilize the same switch arm 26 of a single pole switch. The housing 50 on each input switch 10 again may be configured to mount in a standard electrical panel 24. The input switch 10 is removably connected to the electrical panel 24, for example, by pressing or sliding the load contact 20 onto the bus 22. The lower wall 55 of the housing 50 is generally parallel with the electrical panel 24. The housing 50 is elongated with the first end 51 and the second end 52 extending away from the electrical panel 24. A first side 53 and a second side 54 extend between the first end 51 and the second end 53. For each pole of the switch, the height is typically greater than the width of the ends, 51 and 52, and the length is typically greater than the height of the sides, 53 and 54. An upper wall 56 joins the ends, 51 and 52, and sides, 53 and 54, opposite the lower wall 55. The upper wall 56 includes at least one opening 57 for the switch arm 26 to extend therethrough. Additional openings may be formed in the upper wall 56 as required such as the openings, 58 and 59, for the power meter 45 or the visual indicator 60, respectively, to extend therethrough. A single pole switch is configured to connect to a single bus 22 in the electrical panel 24. A double pole switch is configured to connect to two busses 22, typically offset from and extending parallel to each other, in the electrical panel 24.

Figure 4:
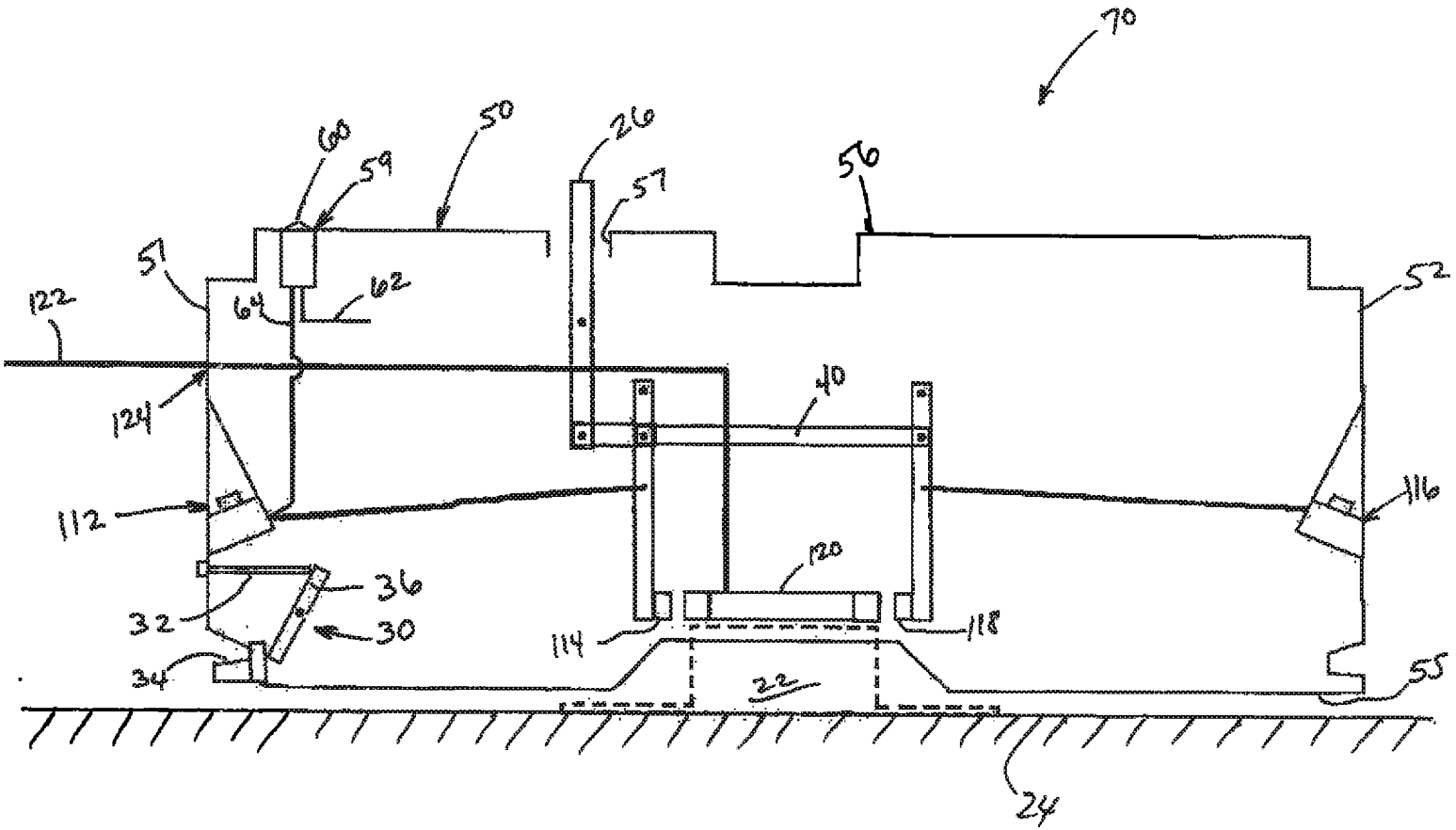
FIG. 4 is a schematic representation of a transfer switch including an internal connection between a terminal and an external conductor according to one embodiment of the present invention.
Figure 5:
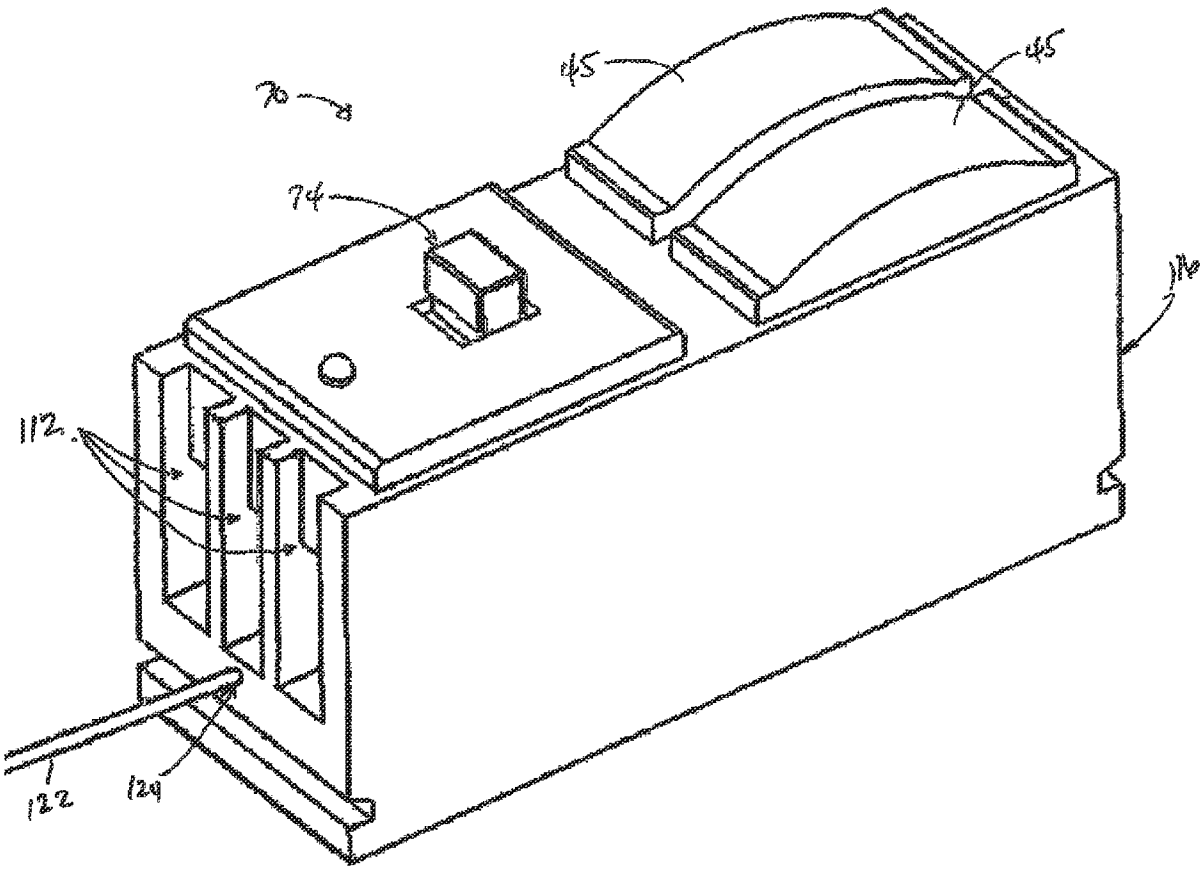
FIG. 5 is a perspective view of a three pole transfer switch incorporating the internal interlock of the present invention.

According to another embodiment of the present invention, the input switch may be incorporated into a three-pole switch 70 as shown in FIG. 5. The three-pole switch 70 uses a two-pole switch and incorporates a neutral segment, as shown in FIG. 4. The three-pole switch 70 functions generally similarly to switch 10 as shown in FIGS. 1-3 and described above, incorporating an internal interlock that connects either a primary or auxiliary power supply to the electrical load.

The three-pole switch 70, in addition to connecting either the first or second power supplies to the two buses 22, includes a neutral switching feature, as shown in FIG. 4. A first side of the three-pole switch 70 includes three terminals 112, two of which are adapted for connection between energized conductors and one of the buses 20 and one of which is adapted for connecting the neutral conductor to a neutral terminal on the panel 24. The opposite side of switch 70 from that shown in FIG. 5 also includes three terminals 116, similar to terminals 112, which likewise are arranged such that two of the terminals are adapted for connection to energized conductors and one of the terminals is adapted for connection to a neutral conductor. On one side of switch 70, the three terminals 112 are connected to two energized conductors and a neutral conductor from a first power supply, such as a utility. On the other side of switch 70, the three terminals 116 are connected to two energized conductors and a neutral conductor from an auxiliary power supply, such as a standby generator.

Similar to the powered connections, the neutral conductor of the first and second terminals, 112 and 116 respectively, is selectively connected to a neutral load contact 120. The first terminal 112 is electrically connected, for example by a wire, to a first contact 114, and the second terminal 116 is electrically connected, for example by a wire, to a second contact 118. The first and second contacts, 114 and 118 respectively, are coupled to the switch arm 26 by a mechanical interlock 40. The switch arm 26 extends through an opening 57 in the upper wall 56 of the housing 50. A single switch handle 74 is utilized to actuate the internal switching and interlock components as described above, as opposed to the tied-together switch handles as shown in the two-pole version of FIG. 3.

The switch arm 26 is selectively positioned between a first and a second position to alternately connect both the powered connections and the neutral connection of either the primary or the auxiliary power source to the buses 22 or panel neutral, respectively. A neutral conductor 122 extends through an opening 124 in the housing to establish an electrical connection between the load contact 120 and the neutral bar of the electrical panel 24, without connection to the powered bus 22 of the electrical panel 24. Thus, when the switch is in the first position, the neutral of the first power source is connected to the neutral conductor 122 and when the switch is in the second position, the utility from the second power source is connected to the neutral conductor 122. The second terminal 64 of the visual indicator 60 is internally connected to the neutral connection from the utility supply rather than the neutral bus of the electrical panel 24 as described above in connection with the two-pole version. It is further contemplated that, when switching between the first position and the second position, the connections between the neutral contacts 114 and 118 and the neutral load contact 120 are configured to be broken after the connections between the contacts, 14 and 18, for the energized connectors and the load contact 20 to the busses 22 of the electrical panel 24. Similarly, the new connection between the other of the neutral contacts 114 and 118 and the neutral load contact 120 are configured to be made prior to the new connection between the other of the contacts, 14 and 18, for the energized connectors and the load contact 20 to the buses 22 of the electrical panel 24.

Figure 6:
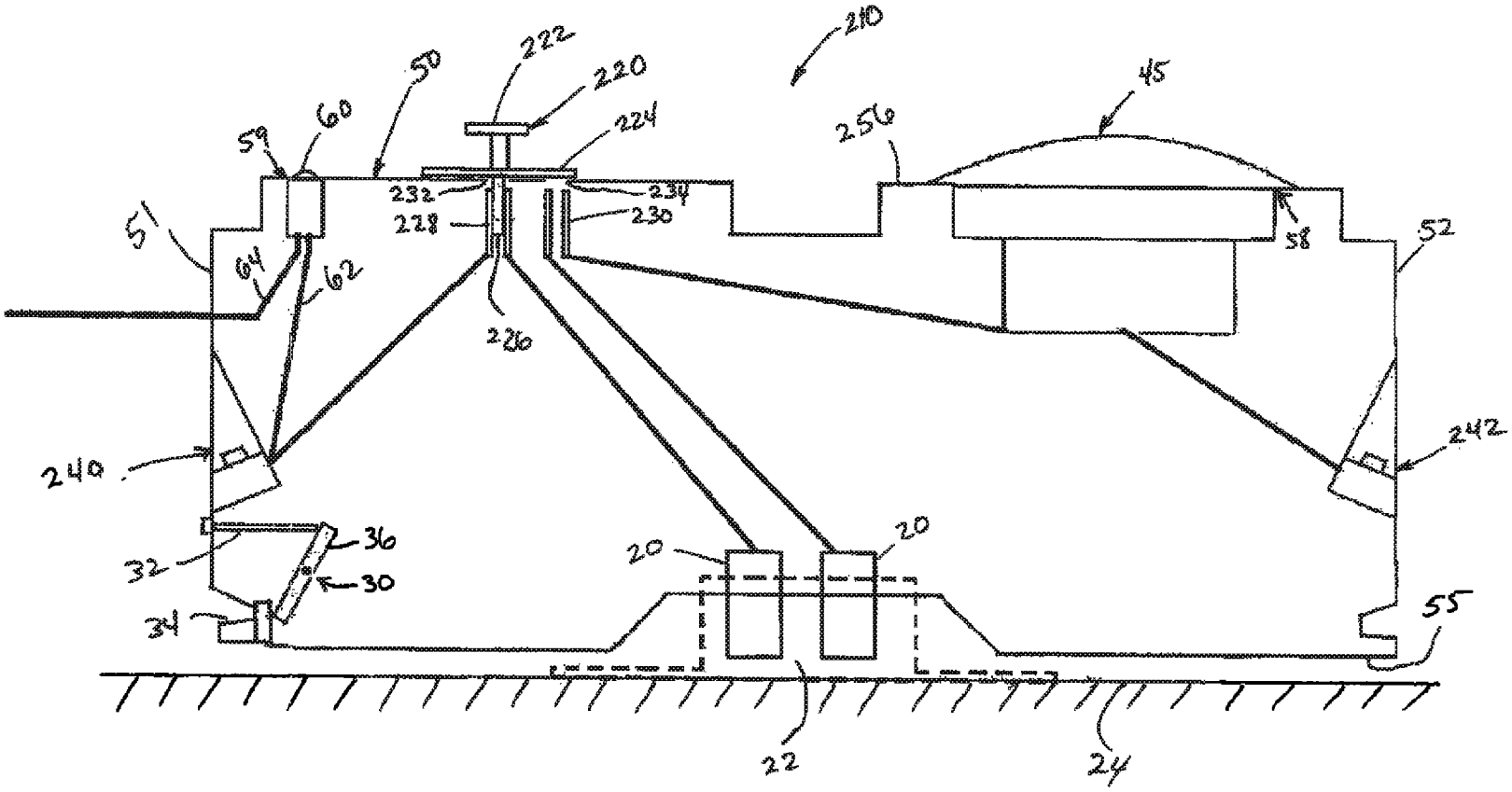
FIG. 6 is a schematic representation of an internal connection between a terminal and a bus according to a second embodiment of the present invention.

According to still another embodiment of the present invention, the internal interlock may be incorporated into the switching member 220. Referring next to FIG. 6, a switch 210 is configured to mount to a panel 24 and connect to either a first power supply or a second power supply. The switch 210 operates in a similar manner as the input switches, 10 and 70, described above. However, the switch arm 26 and mechanical interlock 40 are replaced by a switching member 220. The switching member 220 includes a plate 224 having a handle 222 extending away from a first surface of the plate 224 and a prong or plug 226 extending away from a second surface of the plate 224 in generally the opposite direction from the handle 222. The handle 222 and plate 224 are constructed of an electrically non-conductive material and the plug 226 is constructed of an electrically conductive material.

A first opening 232 and a second opening 234 extend through a wall of the housing 50, such as the upper wall 56 of the housing 50, and the plug 226 slidably extends through either the first opening 232 or the second opening 234. The first and second openings, 232 and 234 respectively, are positioned close enough to each other such that the plate 224 extends over the opening not occupied by the plug 226. As the plug 226 is inserted into either the first or second opening, 232 or 234 respectively, the plug 226 will engage either a first receptacle 228 aligned with the first opening 232 or a second receptacle 230 aligned with the second opening 234.

As the plug 226 engages one of the receptacles, 228 or 230, an electrical connection is established between either the primary or auxiliary power supply and the panel bus 22. Each receptacle, 228 and 230, may include a pair of plates spaced apart from each other. One of the plates is connected to one of the terminals, 240 or 242, which is, in turn, connected to either the utility supply or the auxiliary supply. The other plate is connected to the load contact 20, which is connected to the panel bus 22 as previously described. Because the plates are spaced apart from each other, there is initially no electrical conduction between the plates. The distance between the plates is generally equal to or slightly less than the thickness of the plug 226, such that when the plug 226 is inserted into the receptacle, the plug 226 establishes an electrical connection between the two plates, connecting either the primary or auxiliary power supply to the bus 22. It is understood, however, that the use of spaced-apart plates in the receptacles 228, 230 is representative of any other satisfactory female engagement arrangement that may be employed.

Figure 7:
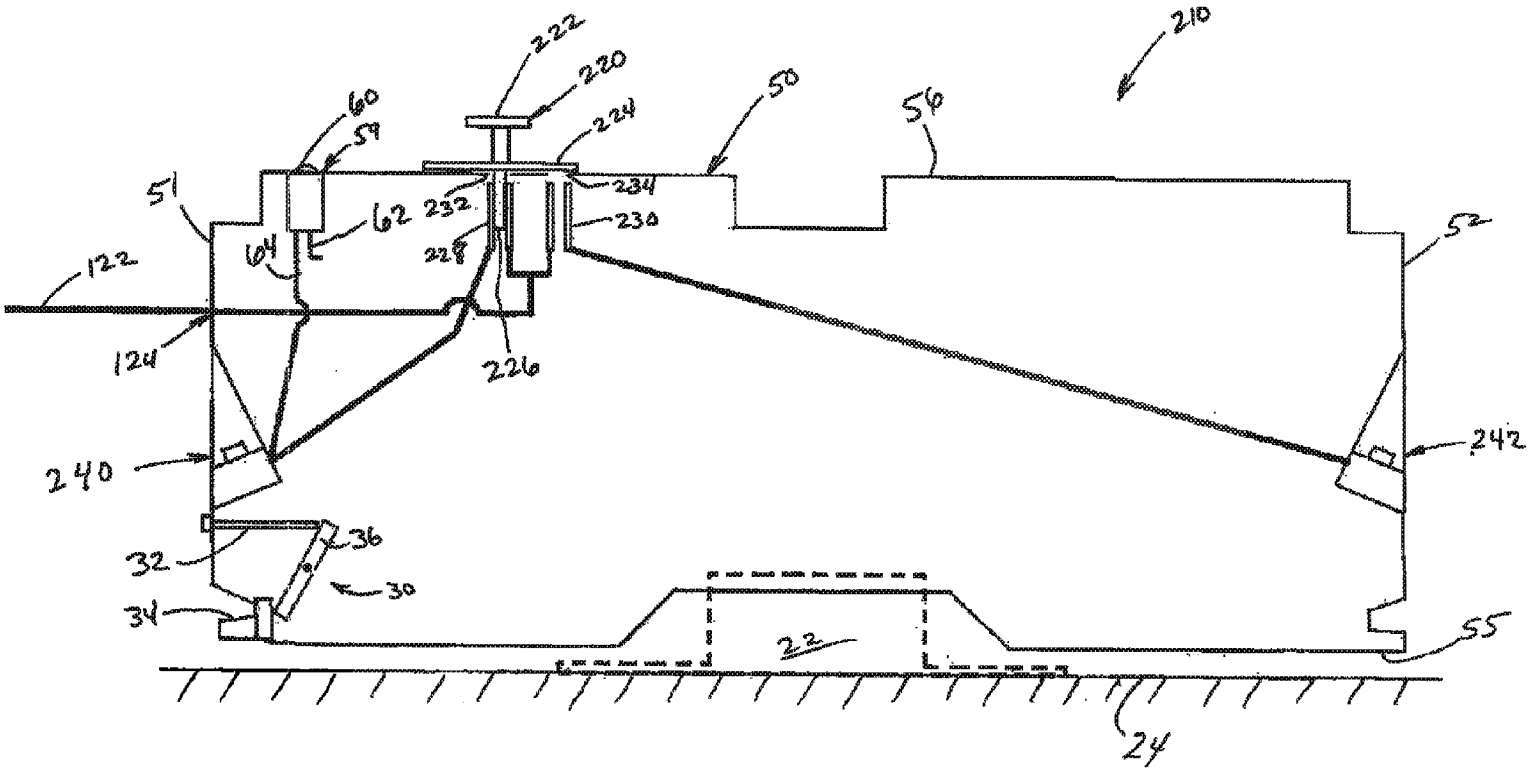
FIG. 7 is a schematic representation of an internal connection between a terminal and an external conductor according to the second embodiment of the present invention.
Figure 9:
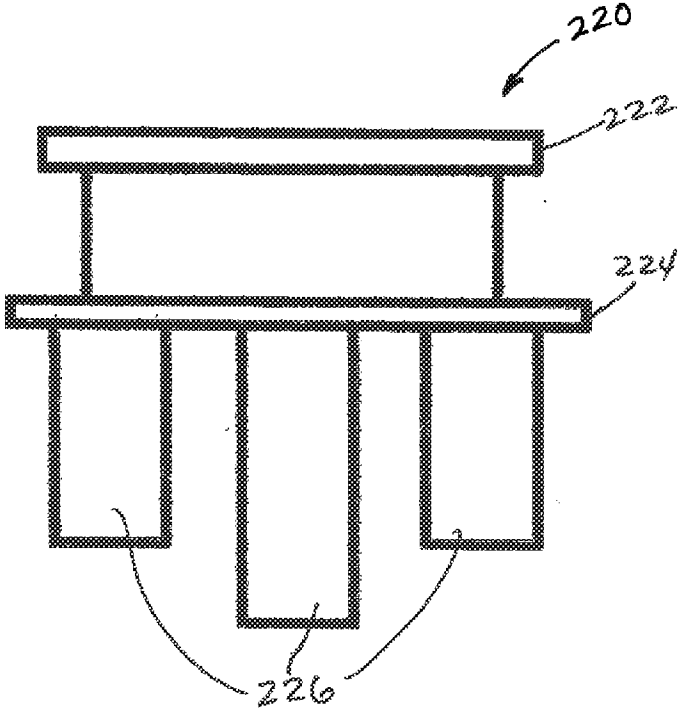
FIG. 9 is a front elevation view of a switching member illustrated in FIG. 7.
Figure 8:
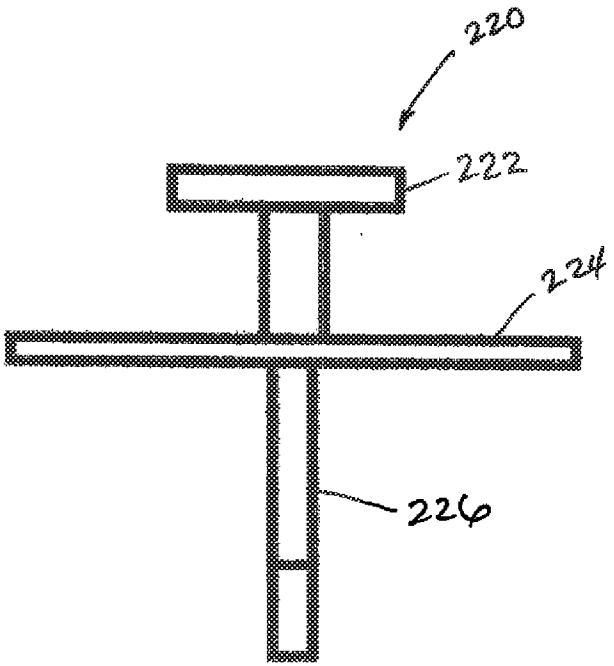
FIG. 8 is a side elevation view of a switching member illustrated in FIG. 7.

Referring next to FIG. 7-9, the switching member 220 may also selectively establish an electrical connection between the neutral conductor from either the primary or auxiliary supply power and the neutral bus on the panel 24. In this regard, the switching member 220 may have multiple prongs or plugs 226, and each plug 226 may have a different length. The longest plug 226 is configured to engage one of the receptacles, 228 or 230, connected to the neutral conductor from either the primary or auxiliary power supply. As a result, when the hot receptacles are configured and positioned similarly to the neutral receptacles 228, 230, the neutral connection is made first and broken last during switching between power supplies during removal and engagement of the switching member 220. The neutral conductor from the power supply is wired to one of the terminals, 240 or 242, which is, in turn, connected to one of the plates on the receptacles, 228 or 230. The other plate on each of the receptacles, 228 or 230, is connected to an electrical conductor 122 which passes through an opening 124 in the housing 50 and is connected to the neutral bus in the panel 24. Consequently, the switching member 220 may selectively connect both neutral and power conducting leads from either the primary or auxiliary supply to either a neutral bus or a power bus 22 within the panel 24.

It is contemplated that the switch 210 may have multiple configurations without deviating from the scope of the invention. The switch 210 may have, for example, a single pole or multiple poles, connecting power conductors to their respective bus 22. Further, the switch 210 may optionally provide a neutral connection. The switching member 220 includes a plug 226 for each of the power or neutral conductors to be switched between the utility or auxiliary supply. As shown in FIG. 9, the length of the plugs 226 may vary, allowing electrical connection to be established between each plug 226 and the corresponding receptacle, 228 or 230, in a predetermined order. For example, the plug 226 used to switch the neutral conductor may be longer than plugs used to switch powered conductors, such that a neutral connection is established prior to connecting either powered conductor. Establishing the neutral connection first and breaking the neutral connection last is desirable to avoid an open neutral condition and/or prevent undesirable current conducted via the equipment ground wiring.

Figure 10:
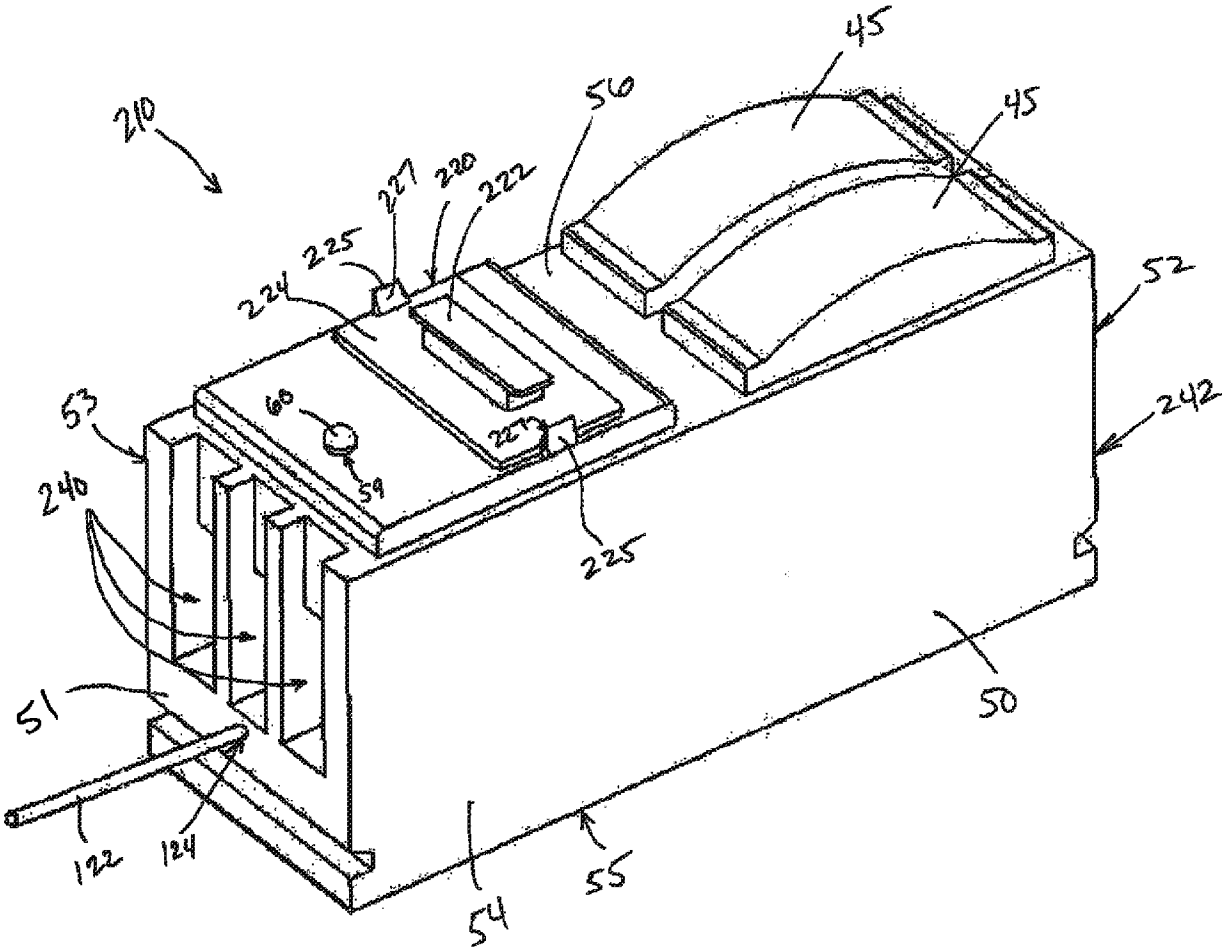
FIG. 10 is a perspective view of a three pole transfer switch incorporating the internal interlock according to the second embodiment of the present invention.

Referring next to FIG. 10, the housing 50 of the switch 210 is similar to the housing previously described with respect to switch 10 and shown in FIGS. 2, 3, and 5. The switch 210 may include a visual indicator 60, such as an LED, or a power meter 45 mounted on the housing 50. In addition, a pair of tabs 225 may extend away from the upper wall of the housing 50. The tabs 225 may be configured to engage opposite edges of the plate 224 and to positively retain the switching member 220 in the housing 50. In order to move the switching member 220 between the first opening 232 and the second opening 234, pressure is applied to each of the tabs 225 to flex the tab 225 away from the plate 224, allowing the switching member 220 to be removed from housing 50. As the switching member 220 is reinserted, the plate 224 engages a beveled surface 227 on each of the tabs 225, displacing the tabs 225 outward and allowing the switching member 220 to enter the housing 50. When the switching member 220 is reinserted into the housing 50, the plate 224 is located between a shoulder defined by the beveled surface 227 and the upper wall 56 of the housing, allowing the tabs 225 to return to their original position which again positively retains the switching member 220 to the housing 50.

Figure 11:
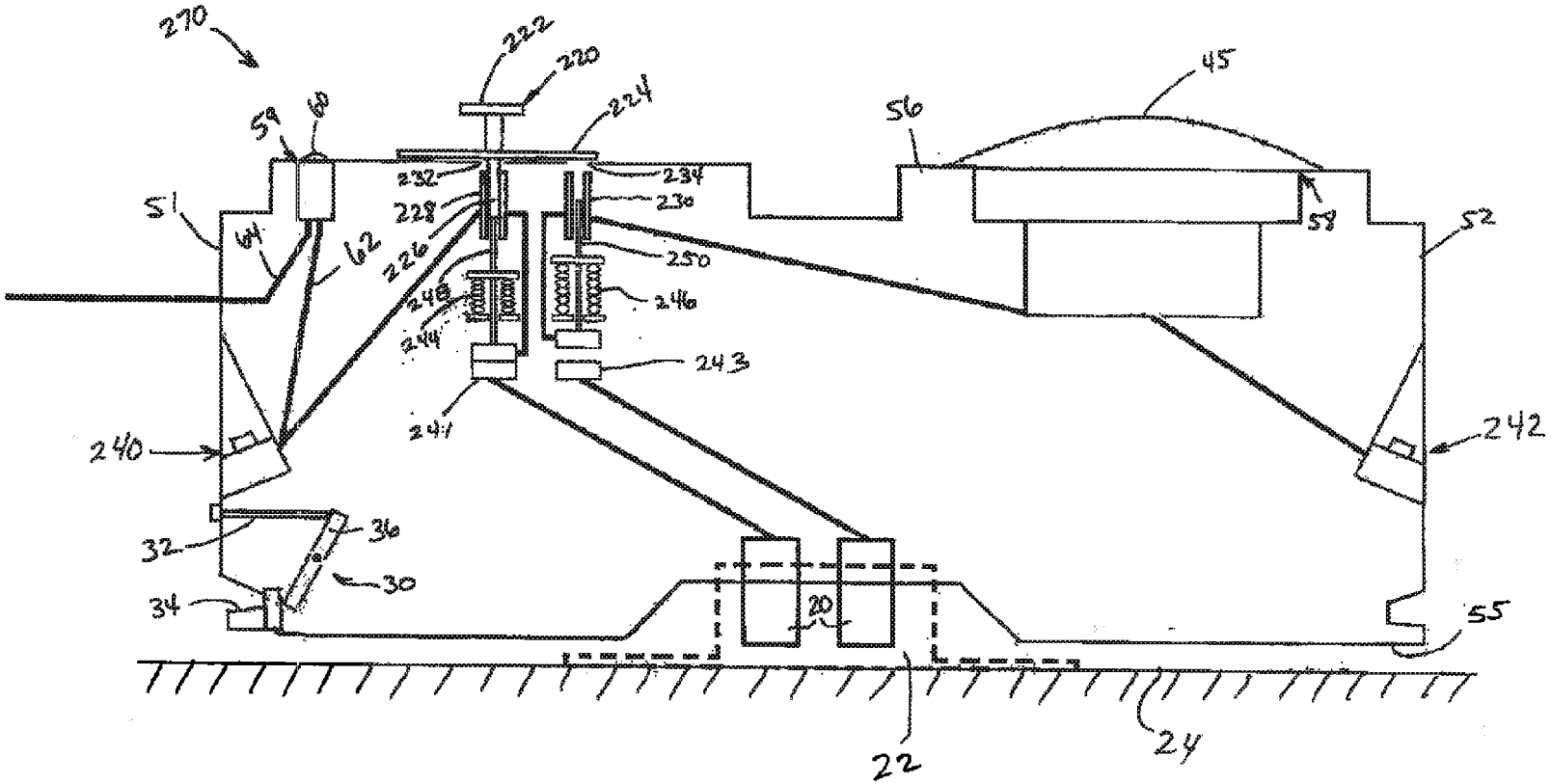
FIG. 11 is a schematic representation of an internal connection between a terminal and a bus according to a third embodiment of the present invention.

Referring now to FIG. 11, a switch 270 may further include a pair of spring-biased contacts, 241 and 243, to connect the powered conductors to the load contact 20. The switch 270 operates in a similar manner as switch 210 described above; however, a spring-biased contact, 240 or 242, is included between the receptacle, 228 or 230 respectively, and the load contact 20. The second plate of each receptacle, 228 or 230, is electrically connected to a first terminal of the spring-biased contact, 241 and 243. The second terminal of each of the spring-biased contacts, 241 and 243, is connected to the load contact 20. A spring, 244 or 246, biases each contact, 241 and 243 respectively, to a normally open position. Each plug 226 on the switching member 220 engages a plunger, 248 or 250, which compresses the spring, 244 or 246, and closes the contact, 241 and 243. Each plunger 248, 250 has a portion normally positioned between the plates of its associated receptacle 228, 230, which is formed of a non-conductive material so as to maintain electrical isolation between the receptacle plates. When the contact, 241 and 243, is closed, an electrical connection from the respective terminal, 240 or 242, to the load contact 20 is established. The tabs 225 positively retain the switching member 220 and hold the spring, 244 or 246, in the compressed state.

Figure 12:
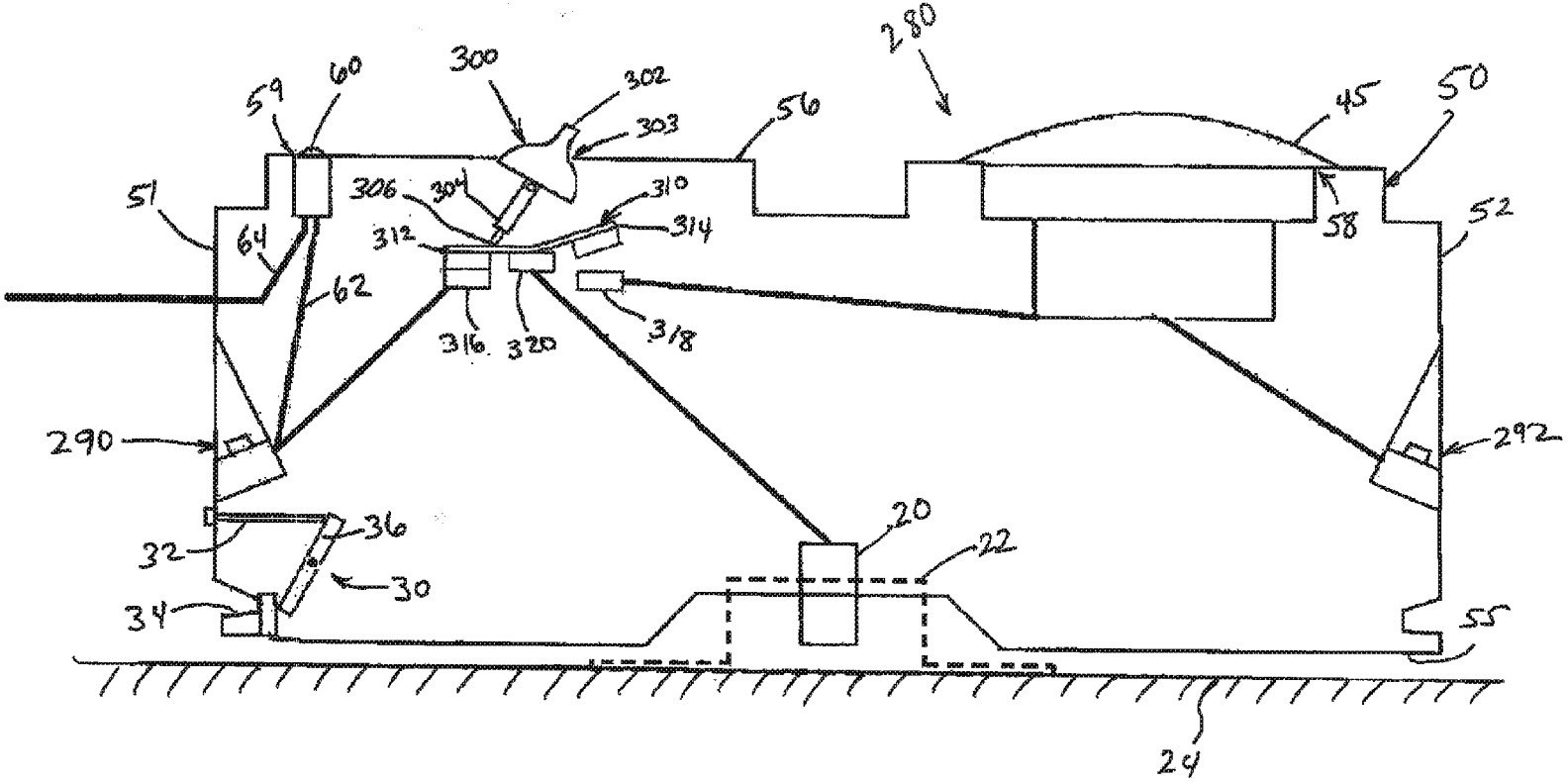
FIG. 12 is a schematic representation of an internal connection between a terminal and a bus according to a fourth embodiment of the present invention.

Referring next to FIG. 12, a toggle switch 300 may selectively establish an electrical connection between either a powered conductor or a neutral conductor and the powered bus 22 or the neutral bus, respectively. A conductor from the primary supply is connected to one of the first terminals 290, and a conductor from the auxiliary power supply is connected to one of the second terminals 292. The first terminal 290 is electrically connected, for example by a wire, to a first contact 316, and the second terminal 292 is electrically connected, for example by a wire, to a second contact 318. The first and second contacts, 316 and 318 respectively, are coupled to the toggle switch 300 by a mechanical interlock 310. The toggle switch 300 extends through an opening 303 in the upper wall 56 of the housing 50 and is selectively positioned between a first and a second position. In the first position, the toggle switch 300 establishes an electrical connection between each of the first terminals 290 and either the powered bus 22 or the neutral bus. In the second position, the toggle switch 300 establishes an electrical connection between each of the second terminals 292 and either the powered bus 22 or the neutral bus.

The mechanical interlock 310 cooperates with the toggle switch 300 to permit only one of the supplies from being connected at a time. The mechanical interlock 310 includes a first segment 312 engageable with the first contact 316 and a second segment 314 engageable with the second contact 318. Each of the first and second segments, 312 and 314, extend from the first and second contacts, 316 and 318, respectively, to a central contact 320 positioned between the first and second contacts, 316 and 318. The first and second segments, 312 and 314, are joined at an angle and pivotable about an axis adjacent to the central contact 320. The first and second segments, 312 and 314, may be integrally formed from a single member having a bend in the middle, but alternately may be formed from multiple members connected at an angle to each other. The toggle switch 300 includes a handle 302 extending out of the housing 50 and an arm 304 extending into the housing 50 to contact the mechanical interlock 310. The distal end 306 of the arm 304 slidably engages the mechanical interlock 310. With the toggle switch 300 in the first position, the distal end 306 of the arm positively engages the first segment 312, closing the first contact 316, and the mechanical interlock 310 rotates about the pivot axis, causing the second segment 314 to open the second contact 318. With the toggle switch 300 in the second position, the distal end 306 of the arm positively engages the second segment 314, closing the second contact 318, and the mechanical interlock 310 rotates about the pivot axis, causing the first segment 312 to open the first contact 312. As the mechanical interlock 310 rotates about the pivot axis, the first or second contact, 316 or 318, that is closed opens before the other of the contacts closes, ensuring that the two supplies are not simultaneously connected to the load.

In operation, the switch 10 is installed in the electrical panel 24 by connecting the load contact 20 to the bus 22. The threaded member 32 of the retaining assembly 30 is rotated into the housing 50, which, in turn, rotates the first end of the lever 36 away from the housing wall. In response, the second end of the lever 36 rotates toward the housing wall, causing the locking member 34 to extend away from the wall. The locking member 34 engages a hook or lip connected to the electrical panel 24 to positively retain the input switch 10 in engagement with the bus 22. An electrical conductor, such as a wire or cable, from the primary supply is connected to the first terminal 12, and an electrical conductor from the auxiliary supply is connected to the second terminal 16.

The switch arm 26 is used to selectively connect either the first power supply or the second power supply to the load. The switch arm 26 is movable between a first and second position, each position connecting one of the power supplies. The mechanical interlock 40 cooperates with the switch arm 26 to permit only one of the supplies from being connected at a time. The switch arm 26 may be connected to the mechanical interlock 40 to similarly move it from a first position to a second position. In the first position, the mechanical interlock 40 operably connects the first contact 14 to the load contact 20. In the second position, the mechanical interlock 40 operably connects the second contact 18 to the load contact 20. As the mechanical interlock 40 moves between the first and second positions, the first or second contact, 14 or 18, which was engaged with the load contact 20 first disengages from the load contact 20 and, subsequently, the other of the first or second contact, 14 or 18, engages the load contact 20. Consequently, at an intermediate position between the first and the second positions neither the first nor second contact, 14 or 18 respectively, engages the load contact 20. Thus, the switch 10 selectively connects either the primary or auxiliary supply to the electrical load while ensuring that the two supplies are not simultaneously connected to the load.

In the alternate embodiment, the switching member 220 may be used to connect either the primary supply or an auxiliary supply to the load. The switching member 220 may be inserted into either the first opening 232 or the second opening 234 to engage either the first receptacle 228 or the second receptacle 230. Each receptacle, 228 and 230, is connected to one of the primary or auxiliary supplies. In the first opening 232, the switching member 220 operably connects the first terminal 240 to the load contact 20. In the second position, the switching member 220 operably connects the second terminal 242 to the load contact 20. In order to change which opening, 232 or 234, the switching member 220 engages, the switching member 220 must be removed from the opening it presently engages and inserted into the other opening. When the switching member 220 is removed from either opening, 232 or 234, neither the first or second terminal, 240 or 242 respectively, engages the load contact 20. Thus, the switch 210 selectively connects either the primary or auxiliary supply to the electrical load while ensuring that the two supplies are not simultaneously connected to the load.

It should be understood that the invention is not limited in its application to the details of construction and arrangements of the components set forth herein. The invention is capable of other embodiments and of being practiced or carried out in various ways. Variations and modifications of the foregoing are within the scope of the present invention.

It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

I claim:

1. An input switch for selectively connecting either a first power supply or a second power supply to an electrical load via a bus in an electrical panel, comprising:

a housing having a first and a second opening extending therethrough;

a load contact configured to engage the bus in the electrical panel;

a first connector configured to receive power from the first power supply;

a first receptacle aligned with the first opening in the housing having a first surface and a second surface electrically isolated from each other wherein the first surface is electrically connected to the first connector and the second surface is electrically connected to the load contact;

a second connector configured to receive power from the second power supply;

a second receptacle aligned with the second opening in the housing having a first surface and a second surface electrically isolated from each other wherein the first surface is electrically connected to the second connector and the second surface is electrically connected to the load contact; and a movable selection device having a plug portion configured to selectively establish an electrical connection between the first and the second surfaces of either the first or the second receptacles.

2. The input switch of claim 1 further comprising a retaining assembly to positively connect the input switch to the bus.

3. The input switch of claim 1, further comprising:

a first spring-biased contact having a first plunger slidably engaging a second end of the first receptacle, wherein a first spring biases the first spring-biased contact in a normally open position and the movable selection device engages the first plunger to compress the first spring, closing the first spring-biased contact; and a second spring-biased contact having a second plunger slidably engaging a second end of the second receptacle, wherein a second spring biases the second spring-biased contact in a normally open position and the movable selection device engages the second plunger to compress the second spring, closing the second spring-biased contact.

4. The input switch of claim 1 wherein the housing has a third and a fourth opening extending therethrough, the input switch further comprising:

a second load contact configured to engage a second bus in the electrical panel;

a third connector configured to connect to the first power supply;

a third receptacle aligned with the third opening in the housing having a first surface and a second surface electrically isolated from each other wherein the first surface is electrically connected to the third connector and the second surface is electrically connected to the second load contact;

a fourth connector configured to connect to the second power supply; and a fourth receptacle aligned with the fourth opening in the housing having a first surface and a second surface electrically isolated from each other wherein the first surface is electrically connected to the fourth connector and the second surface is electrically connected to the second load contact, wherein the plug portion of the movable selection device is configured to selectively establish an electrical connection between the first and the second surfaces of either the first and the third receptacles or the second and the fourth receptacles.

5. The input switch of claim 1 wherein the housing has a third and a fourth opening extending therethrough, the input switch further comprising:

a neutral conductor extending through the housing and configured to be connected to a neutral connection within the electrical panel;

a third connector configured to receive a neutral connection from the first power supply;

a third receptacle aligned with the third opening in the housing having a first surface and a second surface electrically isolated from each other wherein the first surface is electrically connected to the third connector and the second surface is electrically connected to the neutral conductor;

a fourth connector configured to receive a neutral connection from the second power supply; and a fourth receptacle aligned with the fourth opening in the housing having a first surface and a second surface electrically isolated from each other wherein the first surface is electrically connected to the fourth connector and the second surface is electrically connected to the neutral conductor.

6. The input switch of claim 5 wherein the plug portion of the movable selection device is configured to selectively establish an electrical connection between the first and the second surfaces of the first and the third receptacles in a first position and between the first and the second surfaces of the second and the fourth receptacles in a second position.

7. The input switch of claim 6 wherein, in the first position, the movable selection device establishes the electrical connection between the first and the second surface of the third receptacle prior to establishing the electrical connection between the first and the second surface of the first receptacle and breaks the electrical connection between the first and the second surface of the first receptacle prior to breaking the electrical connection between the first and the second surface of the third receptacle.

8. The input switch of claim 6 wherein, in the second position, the movable selection device establishes the electrical connection between the first and the second surface of the fourth receptacle prior to establishing the electrical connection between the first and the second surface of the second receptacle and breaks the electrical connection between the first and the second surface of the second receptacle prior to breaking the electrical connection between the first and the second surface of the fourth receptacle.

* * * * *